US007101224B2

(12) United States Patent
Dattilo et al.

(10) Patent No.: US 7,101,224 B2
(45) Date of Patent: Sep. 5, 2006

(54) INTERCONNECT SYSTEM

(75) Inventors: Jerome P. Dattilo, Cedar Park, TX (US); Richard J. Scherer, Austin, TX (US)

(73) Assignee: 3M Innovation Properties Company, St. Paul, MN (US)

( * ) Notice: Subject to any disclaimer, the term of this patent is extended or adjusted under 35 U.S.C. 154(b) by 0 days.

(21) Appl. No.: 10/658,019

(22) Filed: Sep. 9, 2003

(65) Prior Publication Data

US 2005/0042925 A1 Feb. 24, 2005

(51) Int. Cl.
*H01R 13/648* (2006.01)

(52) U.S. Cl. ..... 439/608

(58) Field of Classification Search ..... 439/608, 439/83, 876, 82

See application file for complete search history.

(56) References Cited

U.S. PATENT DOCUMENTS 4,695,106 A * 9/1987 Feldman et al. ..... 439/83
4,726,793 A * 2/1988 Bright ..... 439/751
4,927,372 A 5/1990 Collier
5,174,764 A * 12/1992 Kandybowski et al. ..... 439/83
5,755,596 A 5/1998 Watson
6,146,202 A 11/2000 Ramey
6,231,391 B1 * 5/2001 Ramey et al. ..... 439/608

OTHER PUBLICATIONS

International Search Report for PCT/US2004/024412.

* cited by examiner

*Primary Examiner*—Phuong Dinh
(74) *Attorney, Agent, or Firm*—Melanie G. Gover

(57) ABSTRACT

Disclosed herein are backplane interconnect systems that use surface mount technology for mating conductive pins in a header connector to surface mount pads on a printed circuit board. In particular, the interconnect system uses a plurality of conductive pins that are not fully inserted into the body of the header connector, thus allowing them to move during mating with a printed circuit board. In this way, the interconnect system exhibits self-leveling characteristics.

14 Claims, 2 Drawing Sheets

INTERCONNECT SYSTEM

FIELD OF INVENTION

The present invention relates to an electrical interconnect system. In particular, the present invention relates to a header connector design that exhibits self-leveling when assembled to a printed circuit board.

BACKGROUND

Various electronic interconnect systems are available in the market place. In one application, two-part electronic backplane connectors are used to couple a motherboard (also known as a "backplane") to a daughtercard. Typically, a socket connector is assembled to the daughtercard while a header connector is assembled to the motherboard.

While various two-part backplane connectors may be available in the market, there is a continuing need for other connector designs that exhibit faster data transmission rate while using a smaller footprint, i.e., smaller amount of surface area or real estate on the motherboard or daughtercard.

SUMMARY

Disclosed herein are interconnect systems that use surface mount technology for mating conductive pins in a header connector to surface mount pads on a printed circuit board. The printed circuit board may and usually does contain other components to mate with the header connector. Although the present invention discloses in detail a header connector for use with a printed circuit board, one skilled in the art will appreciate that the invention can be used in other electronic interconnect systems where self-leveling of the electronic component is desired.

In one aspect, the present invention relates to a header connector compromising: (a) a header body having a front wall, the front wall having a plurality of first and second passageways disposed between an internal surface and an external surface; (b) a plurality of conductive pins configured for insertion into the first passageways, each conductive pin having a first end extending from the internal surface, an intermediate section disposed in the first passageway, and a truncated second end extending from the external surface of the front wall, wherein the conductive pins are not fully inserted into the first passageway; and (c) a plurality of shield blades configured for insertion into the second passageways, each shield blade having a first end extending from the internal surface, an intermediate section disposed in the second passageway, and a second end extending from the external surface of the front wall.

As used herein, the term "truncated", as used to describe the conductive pin, means that one end of the conductive pin, typically the end that will eventually make contact with the surface mount pads of the printed circuit board, is not in the form of an apex but instead is replaced by a substantially planar section. Furthermore, the second end of the conductive pin does not contain a spring like element. The statement that the "conductive pins are not fully inserted into the first opening" means that the conductive pins remain substantially stationary while residing in the header body but during assembly of the header connector to the printed circuit board, the conductive pins will move longitudinally with respect to the front wall of the header body.

In another aspect, the present invention relates to an interconnect system comprising: (a) a printed circuit board comprising a plurality of surface mount pads and a plurality of conductive vias; (b) the header connector of the present invention; and (c) means for holding the header connector to the printed circuit board. Mechanical tolerances exist in the positioning of each conductive pin, i.e., some pins may be slightly higher than others when they were inserted into the front wall of the header body. As the header connector is being assembled to the printed circuit board, each conductive pin of the header connector moves, in relation to the front wall of the header body, longitudinally in the first passageway. The conductive pin moves and makes contact with the surface mount pads. A few first conductive pins may make contact with the surface mount pads while others may not yet have made contact. As the header connector continues to be assembled to the printed circuit board, with respect to the front wall of the header body, the distance between the truncated end of these first contact conductive pins will shorten as other conductive pins (those that still have to be mated) make contact with the surface mount pads. Also during the assembly process, the second end of the shield blades of the header connector mate with the plated through holes (commonly referred to as conductive vias) in the printed circuit board. For reference purposes, when the conductive pins move "longitudinally", it is meant that the pins move in a direction perpendicular to the front wall of the header body and thus normal to the printed circuit board, as the front wall of the header body usually lies substantially parallel to the printed circuit board. In other words, the conductive pins move along its length during the assembly to the printed circuit board.

In yet another aspect, the present invention relates to a method of assembling an interconnect system comprising the steps: (a) providing a printed circuit board comprising a plurality of surface mount pads and a plurality of plated through holes; (b) providing a header connector of the present invention; and (c) assembling the header connector to the printed circuit board such that the shield blades in the header body mate with the conductive vias in the printed circuit board and the conductive pins in the header body move longitudinally to make contact with the surface mount pads on the printed circuit board. The conductive pins stop moving when the header connector is fully assembled to the printed circuit board, i.e., when substantially all of the pins have mated with the surface mount pads.

An advantage of one exemplary embodiment of the present invention is that because the conductive pins are not fully inserted into the first opening of the header body, the pins are free to move with respect to the front wall of the header body when the header connector is assembled to a printed circuit board. This feature allows the plurality of conductive pins to exhibit self-leveling, i.e., each pin can adjust its height, with respect to the front wall of the header body, so that the header connector as a whole will have intimate mechanical, and thus electrical contact between the pin and the surface mount pad. As one skilled in the art will appreciate, due to the uneven and sometimes warped nature of the printed circuit board and the header connector, having a header connector that allows for self-leveling is an advantageous feature because it reduces the need to have tight mechanical tolerances on the header connector as well as the printed circuit board.

An advantage of another exemplary embodiment of the present invention is that because the cross-sectional area of the conductive pin is similar to the surface area of the surface mount pad (each pad preferably containing a conductive path into the printed circuit board), minimal discontinuities are present through the entire electrical communication channel thus minimizing the amount of impedance variance present in the system. As a result, the inventive interconnect system exhibits high electrical performance.

Yet another advantage of another exemplary embodiment is that because the conductive pins are designed to self-level and to contact surface mount pads on the printed circuit board, the insertion force required to assemble a header connector to a printed circuit board can be lower, as compared to an interconnect system using a header connector where both the conductive pins and the shield blades are inserted into plated through hole conductive vias on a printed circuit board.

The above summary of the present invention is not intended to describe each disclosed embodiment or every implementation of the present invention. The Figures and the detailed description, which follow more particularly exemplify illustrative embodiments.

BRIEF DESCRIPTION OF THE DRAWINGS

The present invention can be described with reference to the following figures, wherein.

These figures are idealized, not drawn to scale and are intended for illustrative purposes.

DETAILED DESCRIPTION

Figure 1:
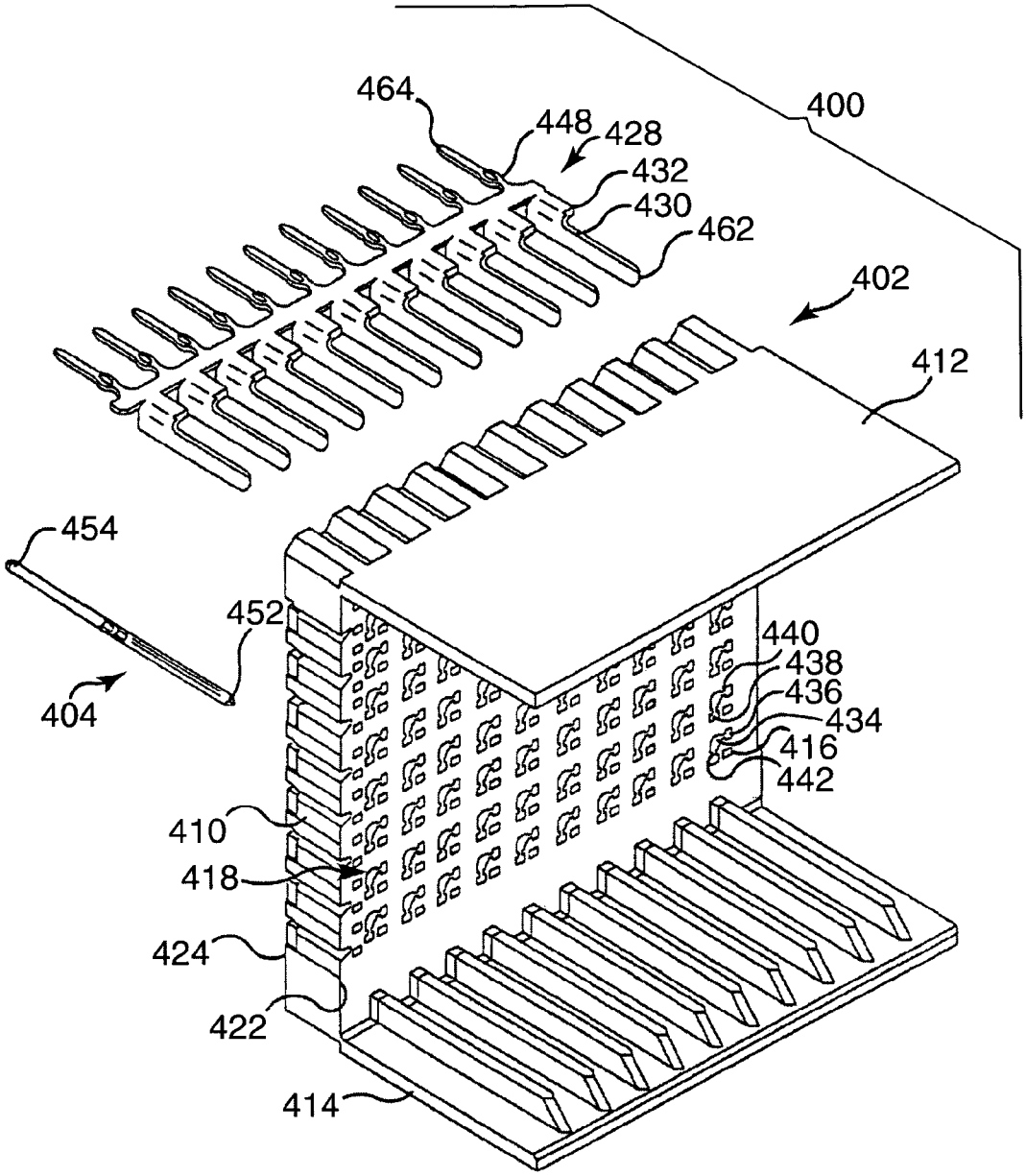
FIG. 1 is an exploded perspective view of one exemplary header connector showing a truncated conductive pin, a continuous strip of shield blades, and a header body; wherein remaining pins and strips of shield blades have been omitted for illustrative purposes.

FIG. 1 shows an exploded view of one exemplary header connector 400 having header body 402, one of a plurality of truncated conductive pins 404, and continuous strip 428 having a plurality of shield blades formed therein. The header body includes vertical front wall 410, having external surface 424 and internal surface 422, and top and bottom laterally extending horizontal walls 412 and 414 projecting from the front wall. The front wall further includes a plurality of first passages 416 for receiving the conductive pins and a plurality of second passages 418 for receiving the shield blades, the passages extending between internal and external surfaces 422 and 424 respectively. The header body is typically molded from suitable thermoplastic materials, such as liquid crystal polymers. The conductive pins and continuous strip of shield blades are typically plated copper alloys. One skilled in the connector art will readily understand that method of making the header body, the conductive pins and the continuous strip of shield blades are known in the art. Although FIG. 1 shows a continuous strip of shield blades, it is within the scope of the present invention to use individual shield blades if desired.

In the embodiment of FIG. 1, each conductive pin has a first end 452 that extends above external wall 422, truncated second end 454 spaced apart from first end 452 and configured for contacting a surface mount pad on a printed circuit board (not shown), and an intermediate portion disposed between the first end and the second end. In use, the intermediate portion lies in the first passages. The shield blades are formed to include generally right angle shielding leg portions (denoted collectively as 430 and 432) configured for insertion into the second passages 418. Each shield blade includes first end 462 that extends above internal surface 422 of the vertical front wall of the header body. In use, first end 462 of the shield blade lies generally adjacent to and substantially parallel to first end 452 of the conductive pin. Second end 464 of the shield blade is spaced apart from first end 462 and is configured for insertion into a plated through hole in the printed circuit board (not shown). Each shield blade also includes shield tail 448, which provides a friction fit to the printed circuit board once inserted therein, and is substantially perpendicular to first and second leg portions 430 and 432 respectively.

In the embodiment of FIG. 1, first passages 416 and second passages 418 are arranged symmetrically in front wall 410 of header body 402 such that generally right angle shielding portions of shield blade substantially surround conductive pins 404 to form a coaxial shield around the conductive pins. Each second passage 418 includes a central portion 434 coupled to first and second end portions 436 and 438 respectively by first and second narrowed throat portions 440 and 442 respectively. The first and second narrowed throat portions are dimensioned to frictionally engage first and second leg portions of the shield blades to hold them in place in the header body. That is to say, the shield blades are fully inserted into the header body in second passages 418. Thus, when header connector 400 is assembled to the printed circuit board, the shield blades remain stationary with respect to the header body. In contrast, conductive pins 404 are not fully inserted into first openings 416 so that as the header connector is assembled to the printed circuit board, the conductive pin can move longitudinally to make contact with the surface mount pad on the printed circuit board. This ability for the conductive pins to move or to float during assembly allows the header connector to self-level, among other advantages.

Figure 2:
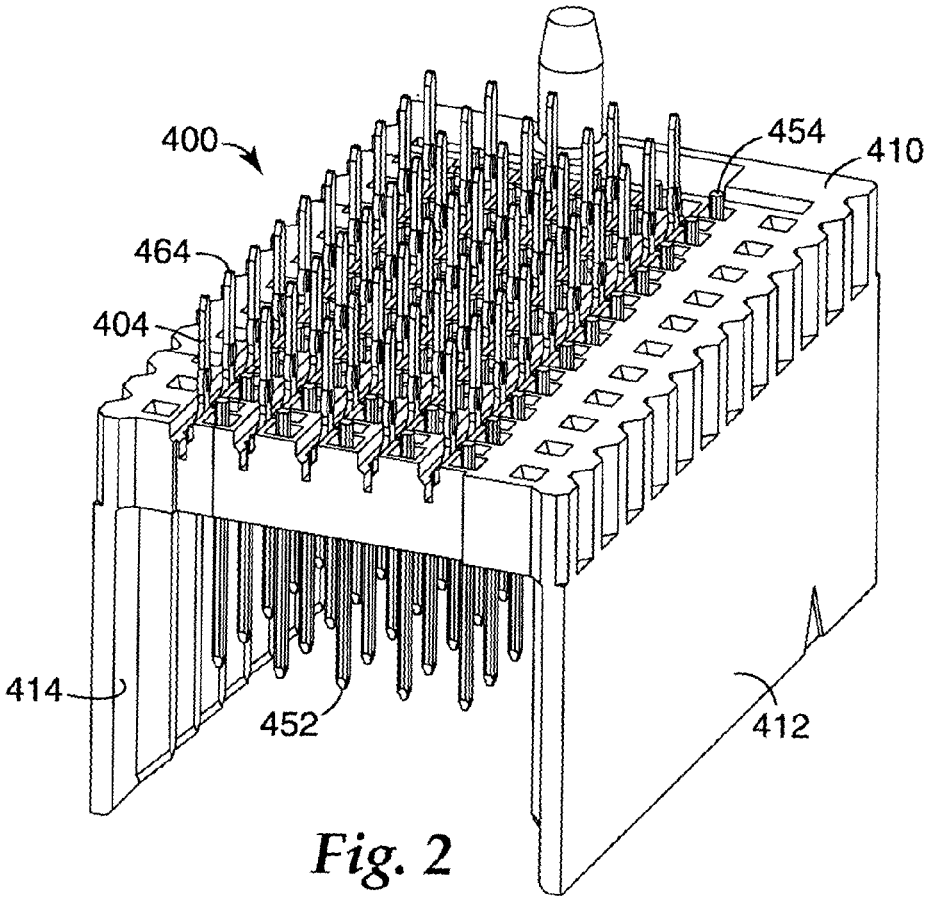
FIG. 2 is a perspective view of the header connector of FIG. 1.

FIG. 2 shows a perspective view of the header connector of FIG. 1 where the conductive pins and shield blades have been installed. As can be seen, the conductive pins are short seated into the header body such that second end 454 extends above front wall 410 by some predetermined height. In one exemplary embodiment, the truncated end of the conductive pin extends about 0.020 inch (0.51 mm) above the external surface of front wall 410 of the header body. One skilled in the art will understand that the height of extension will depend on the intended application of the interconnect system as well as the dimension of the header connector, among other factors. The conductive pins that extend from the external surface of the header body form an array of conductive pins.

The header connector embodied in FIG. 1 represents only one type of header connector that can be used in the present invention. Thus, any header connector that contains a plurality of conductive pins that have a truncated end and a plurality of shield blades can be used in the present invention.

Figure 3:
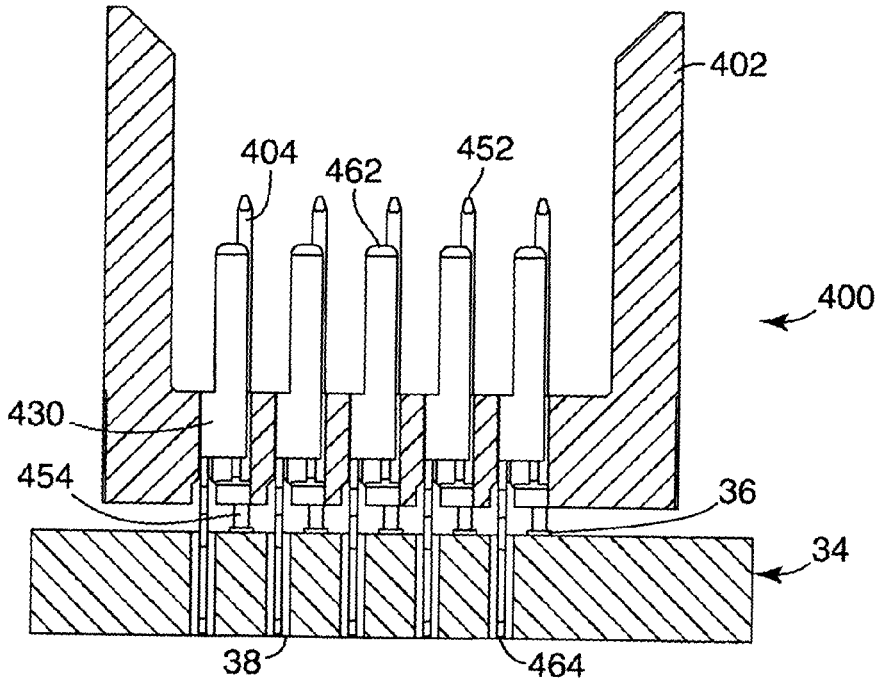
FIG. 3 is a cross-sectional view an interconnect system where the header connector of FIG. 1 has been assembled to one exemplary printed circuit board.

FIG. 3 shows a cross sectional view of the header connector of FIG. 1 assembled on printed circuit board 34. As can be seen, second end 454 of each conductive pin 404 is in direct contact with surface mount pad 36 of the printed circuit board and second end 464 of the shield blades mate with the plated through holes 38 in the printed circuit board. Because the cross sectional area of the conductive pin is similar in dimension to the surface area of the surface mount pad, electrical discontinuities can be minimized. The conductive pins are also designed to be substantially straight with a substantially constant cross section. Furthermore, unlike the prior art, the conductive pin does not contain and does not rely on a spring element at its second end to made mechanical contact with the surface mount pads. The combination of these features results in minimizing the impedance variance of the electrical signal to yield a higher performing, i.e., faster data transmission, interconnects.

When the header connector is used with a printed circuit board to yield an interconnect device, there are means to hold the header connector the board. In the embodiment of FIG. 3, as stated above, frictional forces between the shield tail and the pleated through holes hold the header connector to the printed circuit board while also maintaining the conductive pins in their contact positions to the surface mount pads. One skilled in the art will recognize that other means can be used to hold the header connector to the board, such as, e.g., mechanical means including but not limited to screws or clamps.

Although not shown, socket connectors can be used to mate with the header connector. An exemplary socket connector and connector modules that can be used with the present invention is disclosed in U.S. Pat. Nos. 6,146,202 and 6,231,391 both incorporated by reference in their entirety.

What is claimed is:

1. A header connector comprising:

(a) a header body having a front wall, the front wall having a plurality of first and second passageways disposed between an internal surface and an external surface;

(b) a plurality of conductive pins configured for insertion into the first passageways, each conductive pin having a first end extending from the internal surface, an intermediate section disposed in the first passageway, and a truncated second end extending from the external surface of the front wall for surface mount contact, wherein the conductive pins are not fully inserted into the first passageway; and (c) a plurality of shield blades configured for insertion into the second passageways, each shield blade having a first end extending from the internal surface, an intermediate section disposed in the second passageway, and a second end extending from the external surface of the front wall wherein the second end of the condutive pin does not contain spring like element.

2. The header connector of claim 1, wherein the second end of the conductive pin is substantially flat.

3. The header connector of claim 1, wherein the conductive pin moves longitudinally within the first passageways when the header connector is assembled to a printed circuit board.

4. The header connector of claim 1, wherein the shield blades are fully inserted into the second passageways of the header body.

5. The header connector of claim 1, wherein the intermediate portion of the shield blade has a generally right angle shield portion.

6. An interconnect system comprising:

(a) a printed circuit board comprising a plurality of surface mount pads and a plurality of conductive vias;

(b) the header connector of claim 1; and (c) means for holding the header connector to the printed circuit board, wherein when the header connector is assembled to the printed circuit board, each conductive pin of the header connector move, in relation to the front wall of the header body, longitudinally in the first passageway to contact the surface mount pads and the second end of the shield blades of the header connector mate with the conductive vias in the printed circuit board.

7. The interconnect system of claim 6, wherein the means for holding the header connector to the printed circuit board is provided by frictional force created when the shield blades mate with the conductive vias on the printed circuit board.

8. The interconnect system of claim 6, wherein the second end of the conductive pin is substantially flat.

9. The header connector of claim 6, wherein the shield blades are fully inserted into the second passageways of the header body.

10. The header connector of claim 6, wherein the intermediate portion of the shield blade has a generally right angle shield portion.

11. A method of assembling an interconnect system comprising the steps of:

(a) providing a printed circuit board comprising a plurality of surface mount pads and a plurality of conductive vias;

(b) providing a header connector of claim 1; and (c) assembling the header connector to the printed circuit board such that the shield blades in the header body mate with, the conductive vias in the printed circuit board and the conductive pins in the header body move longitudinally to make contact with the surface mount pads in the printed circuit board.

12. The method of claim 11 further comprising the step of holding the header connector to the printed circuit board.

13. The method of claim 12, wherein frictional force created when the shield blades mate with the conductive vias on the printer circuit board holds the header connector to the printed board.

14. The method of claim 11, wherein the shield blades of the header connector are fully inserted into the second passageways of the header body.

* * * * *

UNITED STATES PATENT AND TRADEMARK OFFICE

CERTIFICATE OF CORRECTION

PATENT NO. : 7,101,224 B2
APPLICATION NO. : 10/658019
DATED : September 5, 2006
INVENTOR(S) : Jerome P. Dattilo It is certified that error appears in the above-identified patent and that said Letters Patent is hereby corrected as shown below:

Column 5, Line 43, in Claim 1, delete "condutive" and insert -- conductive --, therefor.

Column 6,
Line 37, (Approx.), in Claim 11, after "with" delete ",".
Line 41, (Approx.), in Claim 11, delete "in" and insert -- on --, therefor.

Signed and Sealed this

Nineteenth Day of December, 2006

JON W. DUDAS
*Director of the United States Patent and Trademark Office*